United States Patent [19]

Tanaka

[11] 4,450,442

[45] May 22, 1984

[54] DISPLAY PROCESSOR FOR SUPERIMPOSED-PICTURE DISPLAY SYSTEM

[75] Inventor: Kazuyuki Tanaka, Kanagawa, Japan

[73] Assignee: Matsushita Electric Industrial Co., Ltd., Osaka, Japan

[21] Appl. No.: 329,740

[22] Filed: Dec. 11, 1981

[30] Foreign Application Priority Data

Dec. 26, 1980 [JP] Japan ..... 55-186399

[51] Int. Cl.[3] ..... G09G 1/00

[52] U.S. Cl. ..... 340/814; 340/721; 340/745; 358/152

[58] Field of Search ..... 340/721, 744, 750, 745, 340/734, 814; 358/150, 159, 102, 30, 152

[56] References Cited

U.S. PATENT DOCUMENTS

| | | | |
|---|---|---|---|
| 3,413,414 | 11/1968 | Baldwin et al. | 358/152 |
| 4,200,869 | 4/1980 | Murayama et al. | 340/721 |
| 4,316,188 | 2/1982 | Cancasci, Jr. | 340/750 |
| 4,346,407 | 8/1982 | Baer et al. | 340/814 |

*Primary Examiner*—Gerald L. Brigance

*Attorney, Agent, or Firm*—Burgess, Ryan & Wayne

[57] ABSTRACT

A display processor for a raster-display type system comprising a display memory with the capacity of storing at least one page of video information to be displayed over the screen of a cathode-ray tube and a cathode-ray tube (CRT) control circuit which divides the frequency of the externally applied clock pulse to generate the address signal and the vertical and horizontal sync signals, the address signal being applied to the display memory while the vertical and horizontal sync signals are applied to the CRT display device. The present invention further adds a comparator which compares the external vertical synchronizing signal with the internal vertical sync signal and a sync circuit which responds to the output from the comparator to permit or inhibit the passage of the external clock pulse to the CRT control circuit. A plurality of such display processors are used and can be synchronized in operation so that a plurality of pages of video information can be displayed in mutually superimposed relationship on the same face of a cathode-ray tube, whereby versatile displays can be presented.

3 Claims, 6 Drawing Figures

DISPLAY PROCESSOR FOR SUPERIMPOSED-PICTURE DISPLAY SYSTEM

BACKGROUND OF THE INVENTION

1. Field of the Invention

The present invention relates to a display processor for a raster display system for displaying video information such as alphanumeric and graphic patterns on the face of a cathode-ray tube (CRT).

2. Description of the Prior Art

Demands such as resolution on computer-display systems are very versatile and vary from one user to another. For instance, it is desired to display simultaneously a plurality of pages of video information (to be referred to as "display files" for brevity in this specification) so that a plurality of graphic patterns can be displayed in mutually superimposed relationship on the same face of a cathode-ray tube. However, the number of display files to be simultaneously displayed varies from one user to another. As a result, various types of computer display systems must be specially designed and fabricated depending upon the demands of users.

Prior art systems for displaying a plurality of display files in mutually superimposed relationship (to be referred to as "the superimposed-picture display system" for brevity in this specification) are in general large in size and complex in construction. Furthermore, if such display systems are custom-tailored, their costs would become prohibitively expensive because each system must be specially designed and fabricated.

SUMMARY OF THE INVENTION

The present invention was made to solve the above and other problems encountered in the prior art computer-display system and especially in the superimposed-picture display system.

The primary object of the present invention is, therefore, to provide a display processor for the superimposed-picture display systems, whereby when a plurality of such display processors are used in combination, versatile displays of various video information are represented.

Briefly stated, the present invention relates to an improvement of a display processor of the type having a display file memory with a storage capacity capable of storing at least one display file of character and graphic patterns which can be displayed as one frame on the face of a cathode-ray tube (CRT), and a CRT control circuit which divides the frequency of the clock pulse which is equal to that of the display of one character to generate (a) address signals which in turn are delivered to said display file memory so that each of the address signals specifies a memory location in which is stored video information to be displayed on a predetermined location of the face of the CRT and (b) vertical and horizontal synchronizing signals which in turn are delivered to the CRT. According to the present invention, such a display processor of the type described above is further provided with a comparator circuit for comparing the vertical sync signal generated by the CRT control circuit with an external vertical sync signal, and a sync circuit which is responsive to the output from the comparator circuit for permitting or inhibiting the application of the clock pulse to the CRT control circuit.

A plurality of display processors of the present invention can be used in combination and accurately synchronized with each other in operation so that a plurality of display files can be displayed in superimposed relationship and in any desired combinations on the same face of a CRT in the raster-display system.

The above and other objects, effects and features of the present invention will become more apparent from the following description of a preferred embodiment thereof taken in conjunction with the accompanying drawings.

DESCRIPTION OF THE PREFERRED EMBODIMENT

Figure 1:
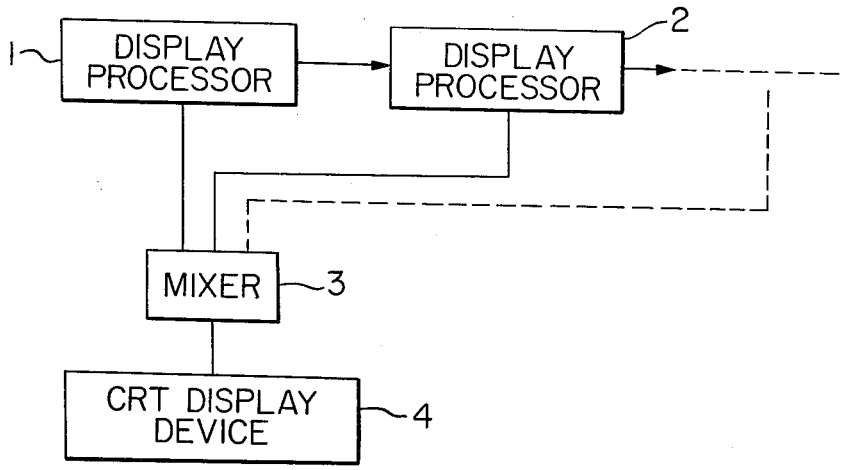
FIG. 1 is a block diagram of a superimposed-picture display system embodying the present invention.

FIG. 1 shows a superimposed-picture display control system embodying the present invention for displaying a plurality of display files in superimposed relationship on the face of a single cathode-ray tube. The control system includes a plurality of superimposed-picture display processors 1 and 2, a mixer 3 for multiplexing the output display signals from the display processors 1 and 2 and a cathode-ray tube display device 4. Each of the display processors 1 and 2, which comprises, in combination, a display file memory, a CRT control circuit and other circuits as will be described in detail below, has the ability of displaying a desired dispaly file or page of video information independently of the other processors.

If only one display processor is used for the display of a plurality of display files in superimposed relationship, it would inevitably become large in size and complex in construction. Therefore, according to the present invention, a plurality of display processors 1 and 2 are used so that the display files processed by and delivered from the display processors 1 and 2 can be displayed in any desired combination and in mutually superimposed relationship on the face of the CRT display device 4.

In order to display a plurality of display files in such a way as described above on the same face plate of the CRT display device 4, the display processors 1 and 2 must operate accurately in response to the same vertical and horizontal sync signal applied to them externally. In addition, the character clock pulse frequencies of the display signals from the display processors 1 and 2 must be correctly synchronized with each other. (The character clock of each display processor is synchronized with one common character clock.)

Figure 2:
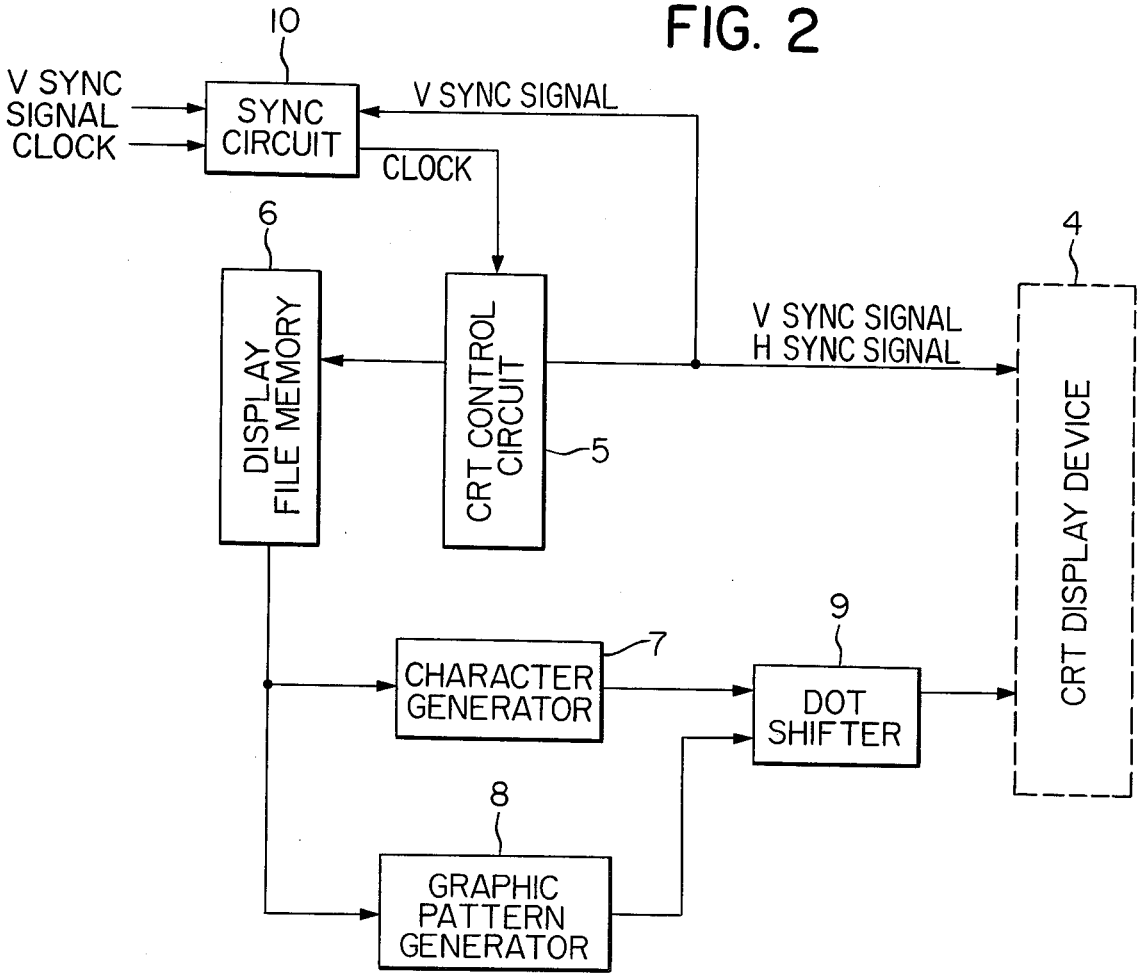
FIG. 2 is a block diagram of a display processor thereof.

In order to attain such synchronization, the display processors 1 and 2 are so designed and constructed as shown in FIG. 2. That is, each display processor comprises a CRT control circuit 5, a display file memory 6, a character generator 7, a graphic pattern generator 8, a parallel-in-serial-out shift register or a dot shifter 9 and a synchronization or sync circuit 10.

The CRT control circuit 5 receives the one-character-display clock pulse from the sync circuit 10, divides the frequency thereof, and delivers the address signal to the display file memory 6. The address signal specifies the location at which is stored one character in the display file or video information to be displayed. The CRT control circuit 5 divides the frequency of the received clock pulse to generate the horizontal and vertical sync signals which in turn are delivered to the CRT display device 4.

In response to the address signal delivered from the CRT control circuit 5, the display file memory 6 delivers the addressed or specified display data, which is previously stored therein, to the character generator 7 and the graphic pattern generator 8. The character and graphic pattern generators 7 and 8 process the delivered display data in a manner well known in the art and parallel-load their outputs into the dot shifter 9 which delivers the parallel-loaded inputs serially to the CRT display device 4 for display in a manner also well known in the art.

The sync circuit 10 receives the externally applied vertical sync signal and the vertical sync signal internally applied from the CRT control circuit 5 and compares them. If the two sync signals are coincident with each other, the sync circuit 10 keeps delivering the clock pulse to the CRT control circuit 5, but when they are not synchronized, the sync circuit 10 stops supplying the clock pulse to the CRT control circuit 5.

Since the vertical sync signal is synchronized with the horizontal sync signal, the synchronization between the externally and internally applied or generated vertical sync signals means the synchronization between the externally and internally generated horizontal sync signals.

Thus, the selected data files processed by and delivered from the image display processors 1 and 2 can be correctly synchronized and synthesized or multiplexed through the mixer 3 so that they can be displayed in mutually superimposed relationship on the same face of the CRT display device 4.

Figure 3:
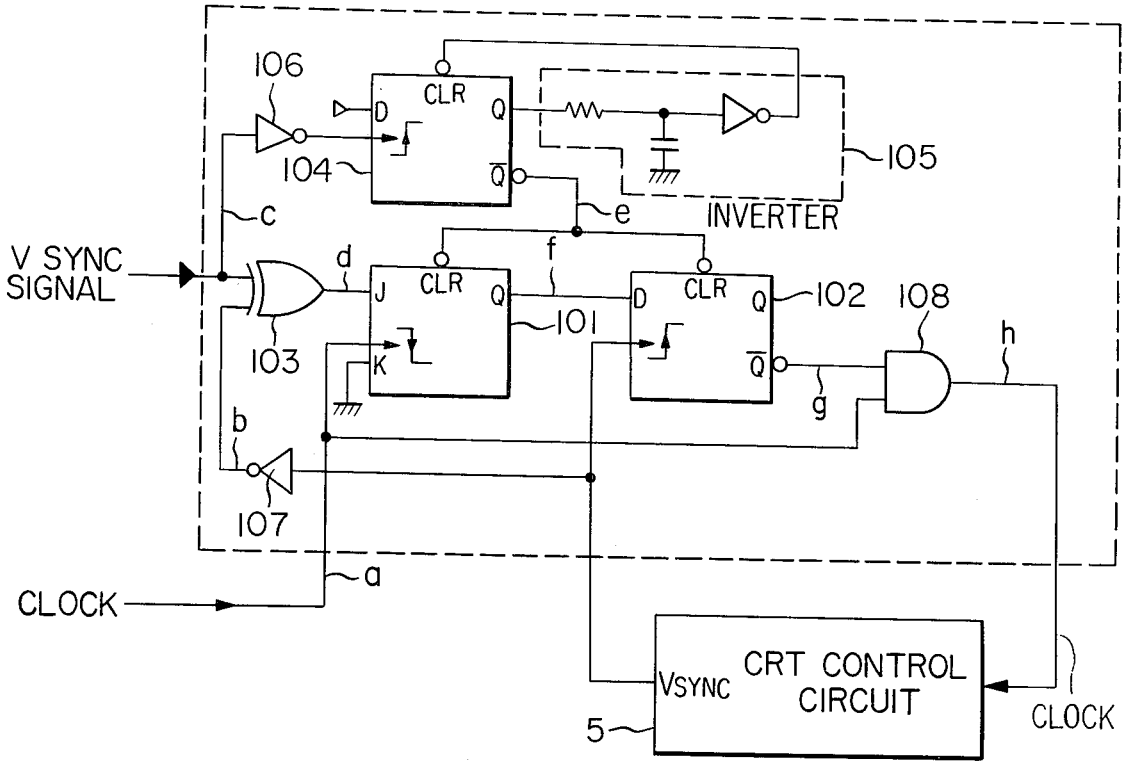
FIG. 3 is a diagram of a sync circuit thereof.

In FIG. 3 is shown the detailed diagram of the sync circuit 10 comprising a JK flip-flop 101, a first D flip-flop 102, an Exclusive OR (XOR) gate 103, a second D flip-flop 104, an inverter 105 which functions as a delay circuit, inverters 106 and 107 and an AND gate 108.

Figure 4:
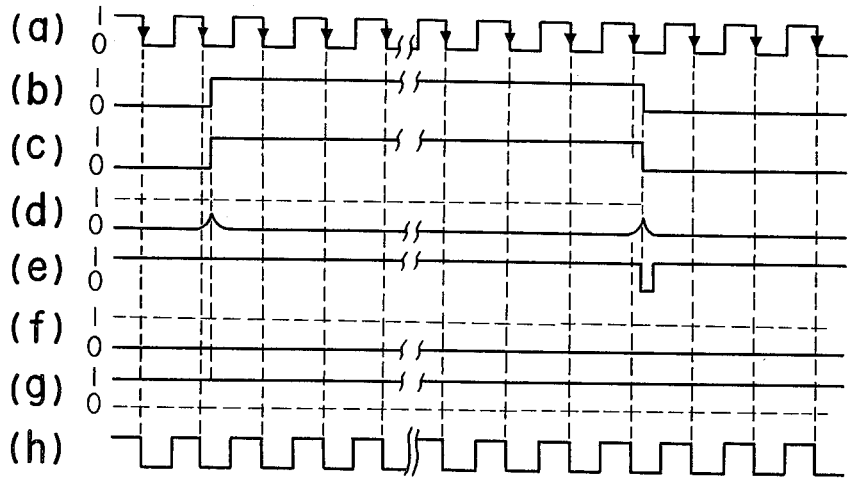
FIGS. 4, 5 and 6 are timing charts used for the explanation of the mode of operation of the sync circuit shown in FIG. 3.
Figure 5:
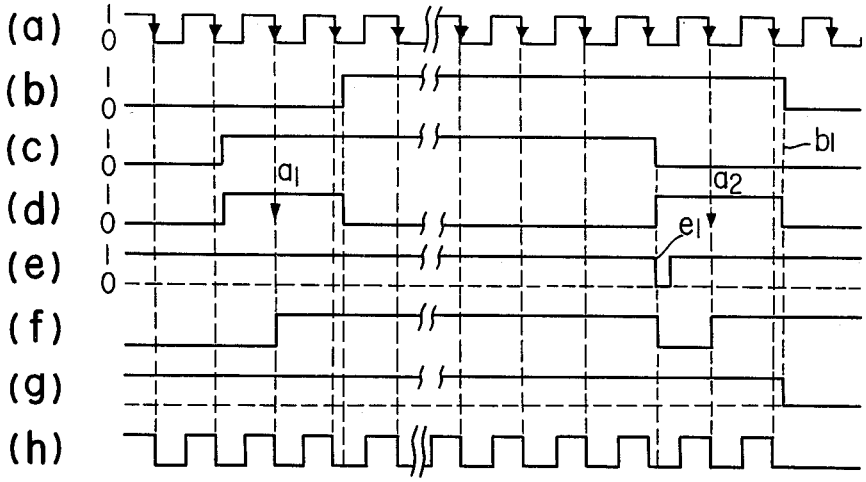

The mode of operation of the sync circuit 10 with the construction as shown in FIG. 3 will be described with reference to the timing diagrams as shown in FIGS. 4 and 5. (a) shows the clock pulses; (b), the output from the inverter 107 which is the reversal of the vertical sync signal; (c), the external vertical sync signal (negative logic); (d), the output from XOR gate 103; (e), the $\overline{Q}$ output of the D flip-flop 104; (f), the Q output from JK flip-flop 101; (g), the $\overline{Q}$ output from the first D flip-flop 102; and (h), the output from AND gate 108.

First, the mode of operation when the external and internal vertical sync signals (b) and (c) are synchronized with each other as shown in FIG. 4 will be described. The XOR gate 103 compares the external vertical sync signal (c) with the output (b) from the inverter 107 and delivers the output (d) to the J input of the JK flip-flop 101. The output (d) is clocked into the JK flip-flop 101 when the clock pulse (a) goes LOW. The Q output from the JK flip-flop 101 is clocked into the D flip-flop 102 when the vertical sync signal from the CRT control circuit 5 goes HIGH. The $\overline{Q}$ output (g) from the first D flip-flop 102 is applied to one of the two input terminals of the AND gate 108. Since the external vertical sync signal (c) and the output (b) from the inverter 107 are synchronized with each other as described previously, the $\overline{Q}$ output from the first D flip-flop 102 is HIGH. The AND gate 108 responds to the $\overline{Q}$ output from the first D flip-flop 102 to permit or inhibit the passage of the clock pulse (a) to the CRT control circuit 5.

The inverter 106, the second D flip-flop 104 and the inverter or delay circuit 105 constitute a pulse generator which generates a short negative pulse (e) when the external vertical sync signal (c) goes HIGH. In response to this pulse (e), the JK flip-flop 101, which is a first memory, and the first D flip-flop 102, which is a second memory, are cleared.

Next, it is assumed that the external vertical sync signal (c) and the output (b) from the inverter 107 are out of synchronism as shown in the timing chart in FIG. 5. During the time when they are out of synchronism, the output (d) from the XOR gate 103 remains HIGH and is clocked into the first memory or JK flip-flop 101 at a time $a_1$ so that the Q output of the flip-flop 101 goes HIGH as shown at (f). At a time $e_1$ the high-level Q output (f) goes LOW and at a time $a_1$ the Q output (f) goes HIGH again. The Q output (f) which goes HIGH and LOW as described above, represents that the external vertical sync signal (c) and the output from the inverter 107 are out of synchronism and is, therefore, referred to as "the noncoincidence signal". The noncoincidence signal (f) is clocked into the second memory or D flip-flop 102 at a time $b_1$ when the output (b) goes LOW so that the $\overline{Q}$ output (g) of the flip-flop 102 goes LOW. As a result, the AND gate 108 inhibits the clock pulse (a) to the CRT control circuit 5. That is, after the time point $b_1$, the output (h) of the AND gate 108 remains LOW. The $\overline{Q}$ output from the second memory or D flip-flop 102 remains LOW until the pulse (e) goes LOW; that is, until the time whens the external vertical sync signal (c) goes LOW.

After the time point $b_1$, no clock pulse (a) is applied to the CRT control circuit 5. As a result, the CRT control circuit 5 remains deactivated until the external vertical sync signal (c) goes LOW but is ready to deliver the low-level vertical sync signal as soon as it is activated again. Therefore, when the external vertical sync signal (c) goes HIGH again, the CRT control circuit 5 is activated again so that the external and internal vertical signals are immediately synchronized.

Figure 6:
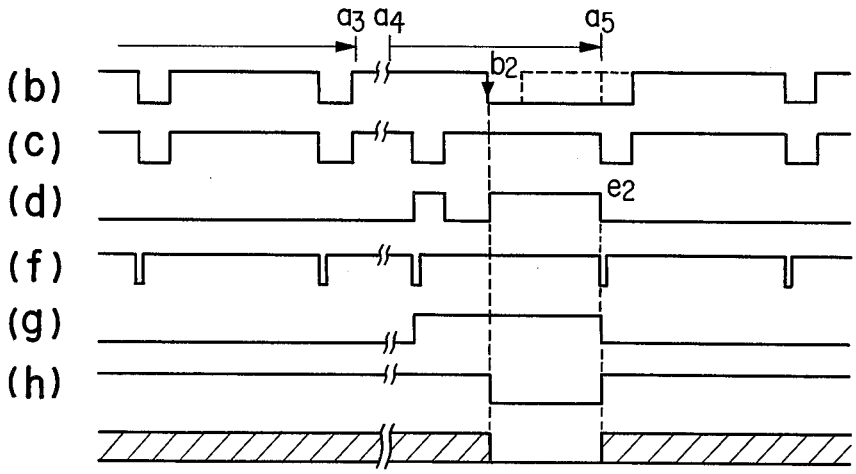

Next, referring to FIG. 6, the general mode of operation will be described. Until the time point $a_3$, the external and internal vertical sync signals are synchronized, but from the time point $a_4$ to the time point $a_5$ they are out of synchronization. At the time $b_2$, the $\overline{Q}$ output of the flip-flop 102 goes LOW as shown at (g) so that the output from the AND gate 108 also goes LOW as shown at (h). At the time point $e_2$, the $\overline{Q}$ output goes HIGH again so that the external and internal vertical sync signals are synchronized.

As described above, according to the present invention, the operation of the display processors 1 and 2 is accurately synchronized with the external vertical sync signal or reference signal so that the operation of all the display processors 1 and 2 can be synchronized precisely in a very simple manner. As a consequence, a plurality of display files each from each of a plurality of display processors 1 and 2 can be accurately aligned and superimposed with each other when displayed on the same screen of the CRT display device 4. Thus, versatile displays can be provided.

It is to be understood that the present invention is not limited to the embodiment described above with reference to the accompanying drawings and that various modifications can be effected. For instance, instead of the inverters 105 and 106 and the flip-flop 104, monostable multivibrators can be used. In addition, instead of the flip-flops 101 and 102, T or R flip-flops or other types of memories can be used. Furthermore, instead of the AND gate 108, a switching circuit can be employed. So far, the outputs from the display processors 1 and 2 have been described as being mixed or multiplexed by the mixer 3 (See FIG. 1) so that a plurality of display files; that is, as plurality of pages of video information can be displayed in mutually and accurately superimposed relationship on the same screen. But it is to be understood that they can be also displayed in a time-division manner. In the latter case, graphs or the like can be displayed with a higher degree of resolution. In addition, three display processors can be so designed, constructed and combined that they deliver red, green and blue video signals, respectively, of the same picture. These three color video signals can be combined to display a color picture on a cathode-ray tube screen. Thus, the applications of the present invention are very versatile.

What is claimed is:

1. In a superimposed-picture display system for displaying a plurality of pictures in a mutually superimposed relationship, a plurality of display processors for generating display signals for displaying said plurality of pictures, respectively, each display processor being of the type comprising:

(a) a display file memory with a storage capacity capable of storing one of at least one display file of character information and graphic patterns, which can be displayed as one frame on the screen of a raster-display type cathode-ray tube, and (b) a cathode-ray-tube control circuit which divides the frequency of a clock pulse which is supplied from another display processor to generate (i) address signals which in turn are delivered to said display file memory so that each of said address signals specifies a memory location in which is stored video information to be displayed at a predetermined location on the screen of said raster-display type cathode-ray tube, and (ii) vertical and horizontal sync signals which in turn are delivered to said raster-display type cathode-ray tube, characterized by the provision that each said display processor further comprises:

(A) a comparator circuit for comparing the vertical sync signal generated by said cathode-ray-tube control circuit with an external vertical sync signal which is supplied from another display processor, and for producing an output in response thereto, (B) a first memory means which stores the output from said comparator means in response to said clock pulse and which produces an output in response thereto, (C) a second memory means which stores the output from said first memory means in response to the vertical sync signal generated by said cathode-ray-tube control circuit and which produces an output in response thereto, (D) a two-input AND gate having one input of which is supplied with the output of said second memory means and another input of which is applied with said clock pulse, the AND gate applying an output in response thereto to said cathode-ray-tube control circuit, and (E) means for resetting said first and second memory means in response to said external vertical sync signal.

2. A superimposed-picture display system as set forth in claim 1; further characterized in that the system comprises a mixer circuit adapted to mix said display signals from said plurality of display processors so that said pictures can be displayed in a mutually superimposed relationship on the screen of the raster-display type cathode-ray tube.

3. A superimposed-picture display system as set forth in claim 2 further characterized in that said mixer circuit comprises an OR gate.

* * * * *